US005361837A

United States Patent [19]

Winbow

[11] Patent Number: 5,361,837

[45] Date of Patent: Nov. 8, 1994

[54] METHOD FOR PREVENTING ANNULAR FLUID FLOW USING TUBE WAVES

[75] Inventor: Graham A. Winbow, Houston, Tex.

[73] Assignee: Exxon Production Research Company, Houston, Tex.

[21] Appl. No.: 981,734

[22] Filed: Nov. 25, 1992

[51] Int. Cl.[5] ..... E21B 33/14

[52] U.S. Cl. ..... 166/249; 166/286

[58] Field of Search ..... 166/249, 286, 177; 175/56

[56] References Cited

U.S. PATENT DOCUMENTS

| | | | |
|---|---|---|---|
| 2,866,509 | 12/1958 | Brandon | 166/249 X |
| 3,133,591 | 5/1964 | Brandon | 166/249 |
| 3,557,875 | 1/1971 | Solum et al. | 166/286 |
| 4,407,365 | 10/1983 | Cooke, Jr. | 166/249 |
| 4,512,401 | 4/1985 | Bodine | 166/249 |
| 4,640,360 | 2/1987 | Bodine et al. | 166/286 |
| 4,667,742 | 5/1987 | Bodine | 166/301 |
| 4,736,794 | 4/1988 | Bodine | 166/286 |
| 4,993,001 | 2/1991 | Winbow et al. | 367/144 |
| 5,152,342 | 10/1992 | Rankin et al. | 166/286 |

FOREIGN PATENT DOCUMENTS 1086127A 4/1984 Russian Federation ..... E21B 43/00

OTHER PUBLICATIONS

Cooke, C. E., Gonzalez, O. J. and Broussard, D. J., "Primary Cementing Improvement by Casing Vibration During Cement Curing Time", SPE 14199, presented at the 60th Annual Technical Conference and Exhibition of the SPE held in Las Vegas, Nev., Sep. 22–25, 1985.

*Primary Examiner*—William P. Neuder

*Attorney, Agent, or Firm*—Keith A. Bell; Kurt D. Van Tassel

[57] ABSTRACT

The current invention is an improved method for preventing annular fluid flow following primary cementing of a casing string in a wellbore. The method involves injecting high pressure pulses of a working fluid into a liquid-filled casing string to produce tube waves that will propagate through the casing liquid until they encounter a casing restriction or barrier. This encounter vibrates the casing string. Vibration of the casing string helps to maintain the pressure of the cement slurry at or above the pressure of fluids in the surrounding formations, thereby preventing or reducing annular fluid flow.

22 Claims, 4 Drawing Sheets

PRIOR ART

PRIOR ART

METHOD FOR PREVENTING ANNULAR FLUID FLOW USING TUBE WAVES

FIELD OF THE INVENTION

This invention relates to an improved method for preventing annular fluid flow following primary cementing of a well casing. More particularly, the invention pertains to using tube waves for vibrating a well casing, either continuously or intermittently while the cement slurry is hardening, to prevent the fluids in the surrounding formations from entering the cemented annulus.

BACKGROUND OF THE INVENTION

The oil and gas industry has known for some time that vibrating a casing during primary cementing can improve cementing of the casing to the wellbore. Vibrating the casing will drive out air pockets and break the gel strength of the cement slurry used in primary cementing which in turn helps maintain the slurry's pressure above the pressure of fluids in the surrounding formation. Breaking the cement slurry's gel strength and driving out its air pockets are believed, therefore, to prevent a phenomenon known as annular fluid flow. Annular fluid flow occurs where a gas or liquid from one formation flows to the surface or to another formation through the cemented annulus before the cement develops sufficient strength to prevent such fluid flow.

Annular fluid flow leads to either an increased permeability of or surface channel formation on the cement sheath which fixes the casing in the wellbore. Such increased permeability or surface channels provide a means for fluid communication between a zone containing hydrocarbons and a zone containing nonhydrocarbon fluids in the formations surrounding the wellbore. Both of these fluid communication pathways permit nonhydrocarbon fluids to flow to the casing/cement sheath perforations which provide the passages for producing hydrocarbons into the casing borehole. Both pathways may also permit hydrocarbon fluids to flow in and contaminate adjacent water sands. Therefore, the cement sheath's ability to prevent mixing of nonhydrocarbon fluids with produced hydrocarbons is significantly diminished as a result of annular fluid flow.

A more detailed discussion and examples of annular fluid flow are provided in U.S. Pat. No. 4,407,365 issued to C. E. Cooke, Jr., Oct. 4, 1983 and in a Society of Petroleum Engineers ("SPE") paper, SPE 14199, by C. E. Cooke, O. J. Gonzalez, and D. J. Broussard, entitled *Primary Cementing Improvement by Casing Vibration During Cement Curing Time*, presented at the 1985 Annual Technical Conference, Las Vegas, Nev., September 22–25.

As a pipe or casing suspended in a liquid is vibrated, various types of vibrational modes may be established such as tube waves, extensional waves, torsional waves, flexural waves, and string waves. In the following discussion, only tube waves and extensional waves will be discussed since those are the types of vibrational modes most capable of transmitting energy downhole.

Extensional waves are produced in the solid body of the casing when energy in the form of a mechanical force is transferred to the casing substantially parallel to its longitudinal axis. Extensional waves are damped by liquid-solid and/or solid-solid frictional forces. Liquid-solid friction damps extensional waves as liquid drags on the casing wall. Solid-solid friction damps extensional waves as the outside of the casing wall contacts the borehole wall. An extensional wave's travel distance, therefore, is dictated by the magnitude of the energy transferred to the casing and the damping forces acting on it. As a result of such damping forces, extensional waves in well casings typically have a limited travel distance, which is generally on the order of a thousand feet or less.

Tube waves are propagated through a liquid contained in the casing when a pressure pulse is injected into the liquid. Tube waves transmit most of their energy through the liquid and therefore are not affected by friction of the casing on the borehole wall. Tube waves are damped to a certain extent by liquid-solid frictional forces, but generally, their damping affect on tube waves is only slight. Therefore, tube waves can travel substantial distances through a liquid filled casing with little attenuation to their amplitude.

In their SPE publication Cooke et al. suggested vibrating the well casing by pushing and pulling on the end of the pipe at the wellhead. This method proved to be impractical because the extensional waves thereby produced were attenuated too rapidly to produce any significant vibration at depths in excess of about 1000 feet. Other methods of vibrating casing disclosed in Cooke's U.S. Pat. No. 4,407,365 include using intermittent explosive charges to cause pressure pulses, explosive charges to propel a projectile against the casing wall, or hydraulic jars or electrical, mechanical, or hydraulic vibrators to directly vibrate the casing wall. Some of these vibration techniques can be employed to deliver their vibrating force at preselected depths by lowering the charge or vibrator on a wireline. However, such a procedure would add significant time and expense to the cementing process.

Therefore, a need exists for an efficient, safe, and cost-effective method for inducing significant downhole vibration at depths of about 1000 feet or more. More specifically, a need exists for an improved method for vibrating a well casing at depths of about 1000 feet or more during primary cementing so that annular fluid flow may be prevented, particularly in regions near the hydrocarbon producing zone of the formation.

SUMMARY OF THE INVENTION

The current invention is a method for injecting pressure pulses into a liquid-filled casing to create tube waves that will propagate downhole through the liquid until they encounter a boundary condition, such as a pipe constriction or barrier, thereby delivering a vibration inducing force downhole.

In one embodiment of the invention, an apparatus comprising a storage tank, a pump, a fluid flow regulating valve, an accumulator, and a rapid action valve is used to produce the pressure pulses. To inject pressure pulses, the rapid action valve is closed and the fluid flow regulating valve is opened so that working fluid is pumped from the storage tank into the accumulator. The accumulator stores the working fluid under pressure and when the pressure reaches a preselected level, the rapid action valve is quickly opened and closed to allow a pulse of high pressure working fluid to enter the liquid-filled casing. The injected pressure pulse creates a tube wave that propagates through the liquid in the casing to deliver force downhole, preferably near a hydrocarbon producing zone. In another embodiment of the invention, the fluid in the casing is pressurized and a rapid action valve is used to vent a portion of this pressurized fluid thereby creating a rarefaction type tube wave. This rarefaction tube wave propagates through the liquid-filled casing until it encounters an obstruction thereby delivering a force downhole.

A series of pressure pulses or rarefaction pulses on alternating pressure and rarefaction pulses may be injected into a liquid-filled casing to vibrate the casing during primary cementing of the casing in a wellbore. Preferably, the pulses are injected until the cement slurry develops sufficient strength to prevent annular fluid flow, most particularly in the region of the hydrocarbon producing zone.

BRIEF DESCRIPTION OF THE DRAWINGS

In order to more fully understand the drawings used in the following detailed description of the present invention, a brief description of each drawing is provided. The appended drawings illustrate only one application of the inventive method. These drawings are not to be considered limiting as the invention may admit to other equally effective embodiments and useful applications for tube waves.

FIG. 1A is a cross-sectional elevation view showing the first step of the displacement procedure.

FIGURE 1B is a cross-sectional elevational view showing the second step of the displacement procedure.

FIG. 1C is a cross-sectional elevation view showing the final step of the displacement procedure.

DESCRIPTION OF THE PREFERRED EMBODIMENT

As discussed above, one need for delivering force downhole, suggested by Cooke in U.S. Pat. No. 4,407,365, is to improve the integrity of the cement sheath used to fix and isolate a casing string in a wellbore. A casing string is comprised of surface casing and production casing. Surface casing extends from the ground surface downwardly for a distance of from a few hundred feet to several thousand feet. Production casing has a slightly smaller diameter than its companion surface casing and is typically positioned adjacent to the hydrocarbon formations to be produced. Normally, both surface casing and production casing are cemented in place.

Figure 1A:
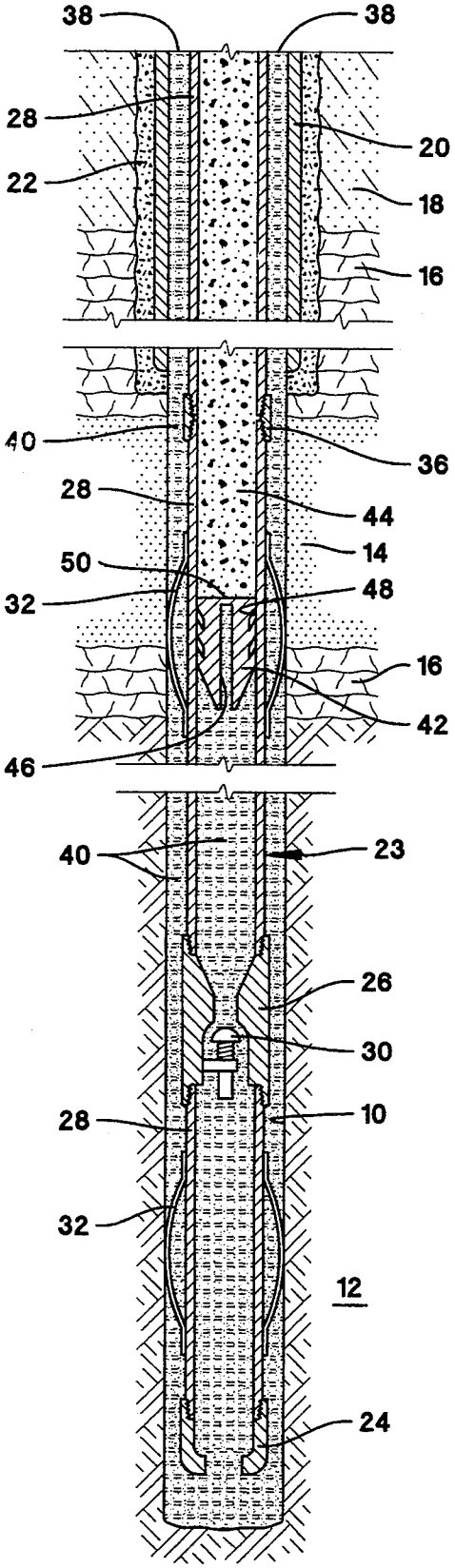
FIGS. 1A through 1C illustrate the various steps involved in a typical production casing primary cementing job.
Figure 1B:
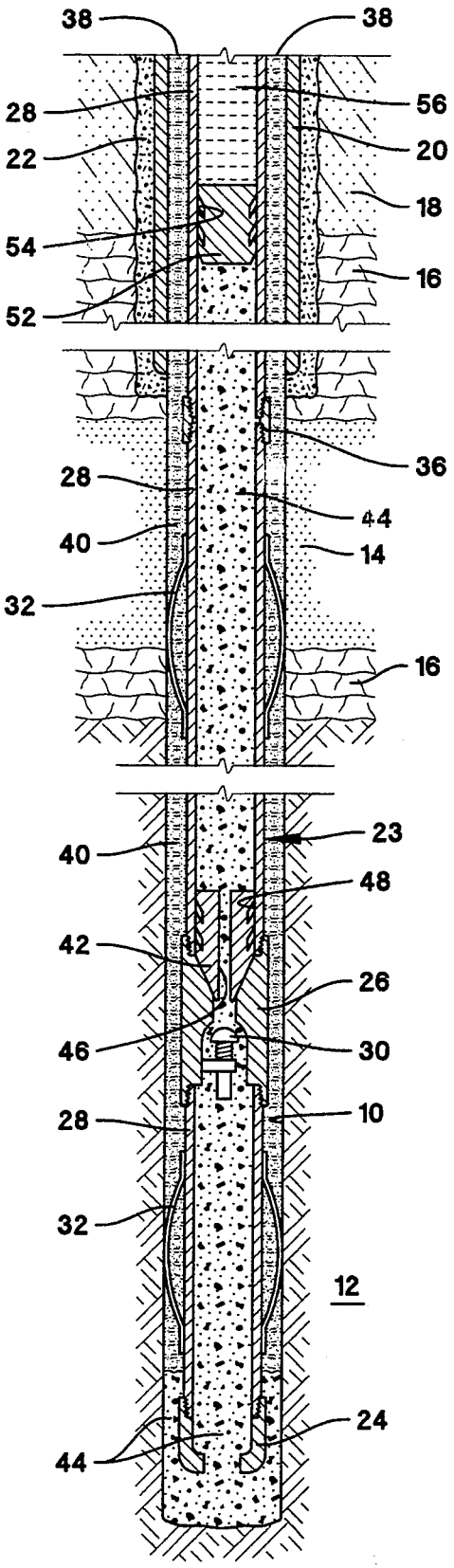
PRIOR ART FIG.1B
Figure 1C:
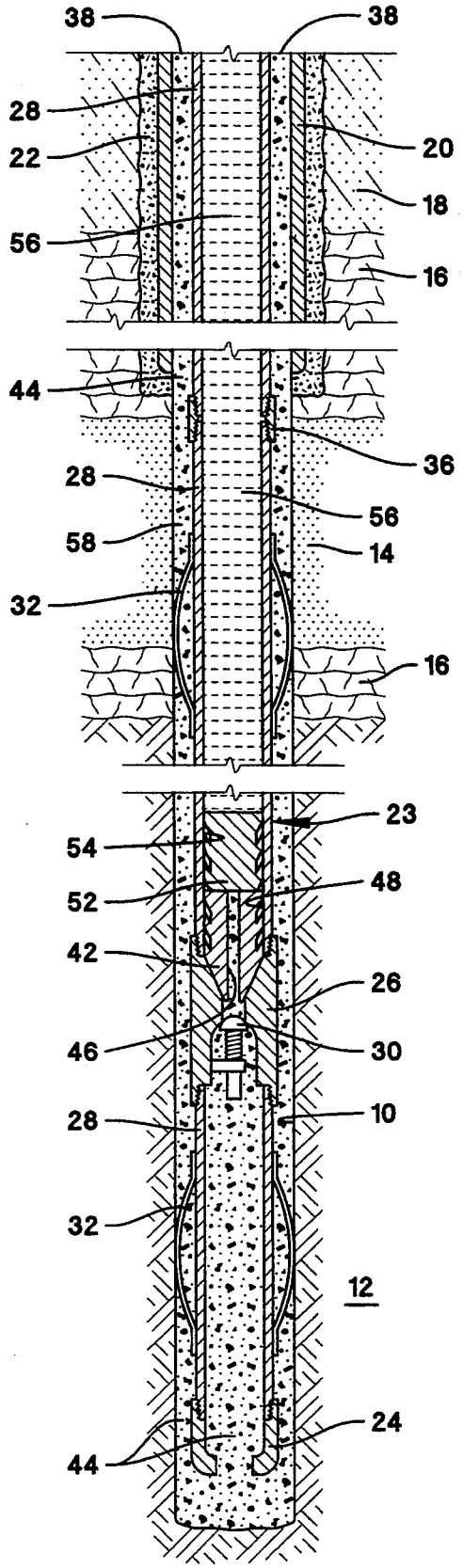

FIGS. 1A through 1C illustrate the various steps involved in a typical production casing primary cementing job. It will be understood that the following discussion and the present invention are equally applicable to the cementing of surface casing and all other casing strings. Referring now to FIG. 1A, there is shown a wellbore 10 drilled into the earth 12 using conventional drilling means. The wellbore 10 passes through one or more hydrocarbon producing formations 14 and, typically, through one or more non-producing formations 16. Additionally, it is likely that the wellbore 10 will penetrate one or more layers of fresh water producing sands 18.

The well is first drilled to a depth sufficient to allow installation of surface casing 20 which is then cemented in place by forming a first cement sheath 22 around the casing. Cement sheath 22 is formed in essentially the same manner as will be hereinafter described.

After surface casing 20 has been installed, a smaller diameter drill bit is used to drill the wellbore to the desired final depth. After wellbore 10 has reached the desired final depth, a casing string 23 consisting essentially of casing shoe 24, float collar 26, and a number of sections of steel production casing 28 is inserted into the wellbore 10. The purpose of casing shoe 24 is to prevent abrasion or distortion of the production casing as it forces its way past obstructions on the wall of the wellbore. Float collar 26 contains a back-pressure valve 30 which permits flow in the downward direction only. Typically, a plurality of casing centralizers 32 are attached at various points along the outer surface of the casing string 23 so as to hold it in the center of the wellbore. Typically, collar 36 is used to connect adjacent sections of production casing 28.

During insertion of the casing string 23 into the wellbore 10, the annulus 38 between the casing string 23 and the wall of the wellbore is filled with drilling fluid 40. The hydrostatic pressure exerted by drilling fluid 40 against hydrocarbon producing formation 14 prevents flow of hydrocarbon fluids from producing formation 14 into wellbore 10.

FIG. 1A illustrates the initial step in the displacement process. Bottom cementing plug 42 is inserted into the casing string and a cement slurry 44 is pumped into the casing string above bottom cementing plug 42. Bottom cementing plug 42 has a longitudinal hole 46 formed through its center, a plurality of annular wipers 48 formed along its outer surface and a diaphragm 50 attached to its top surface to prevent the flow of fluids through longitudinal hole 46. As the cement slurry 44 is pumped into the casing string it pushes bottom cementing plug 42 downwardly. This, in turn, forces drilling fluid 40 to flow downwardly through the casing string and then upwardly through annulus 38. Displaced drilling fluid 40 is collected at the surface of the well (not shown). Back-pressure valve 30 is held open by the downward movement of drilling fluid 40.

The second step of the displacement process is illustrated in FIG. 1B. Bottom cementing plug 42 has been forced downwardly by cement slurry 44 into contact with float collar 26 thereby preventing further downward movement. Further pumping causes the pressure of cement slurry 44 to increase until diaphragm 50 (shown in FIG. 1A only) ruptures. This permits cement slurry 44 to flow downwardly through hole 46 in bottom cementing plug 42 and the remainder of the casing string and then upwardly into annulus 38. Back-pressure valve 30 is held open by the downward movement of cement slurry 44. As above, displaced drilling fluid 40 is collected at the surface of the well. When the planned amount of cement slurry 44 has been pumped into the casing string 23, a top cementing plug 52 is inserted. Top cementing plug 52 has a plurality of annular wipers 54 formed along its outer surface. A displacement liquid 56 is then introduced into the casing string 23 above top cementing plug 52 and pumped downwardly. Typically, displacement liquid 56 would be water.

The final step of the displacement process is illustrated in FIG. 1C. Top cementing plug 52 has been forced downwardly by displacement liquid 56 into contact with bottom cementing plug 42 thereby shutting off further flow through longitudinal hole 46. Pumping is then terminated and the pressure in the casing string 23 above the top cementing plug 52 is released at the surface. Back-pressure valve 30 closes preventing the cement slurry 44 from flowing upwardly in the casing string due to the hydrostatic pressure of the cement slurry in the annulus 38. The cement slurry 44 in annulus 38 may extend to the surface of the well. Alternatively, some drilling fluid (not shown) may remain in annulus 38 above the cement slurry 44. The cement slurry 44 is then allowed to harden forming a cement sheath 58 around the casing string. Upon hardening, the casing string 23 is firmly locked in place by the bond between the cement sheath 58 and the casing string and by the mechanical locks provided by the various protuberances (casing shoe 24, float collar 26, casing centralizers 32, and collars 36).

Figure 2:
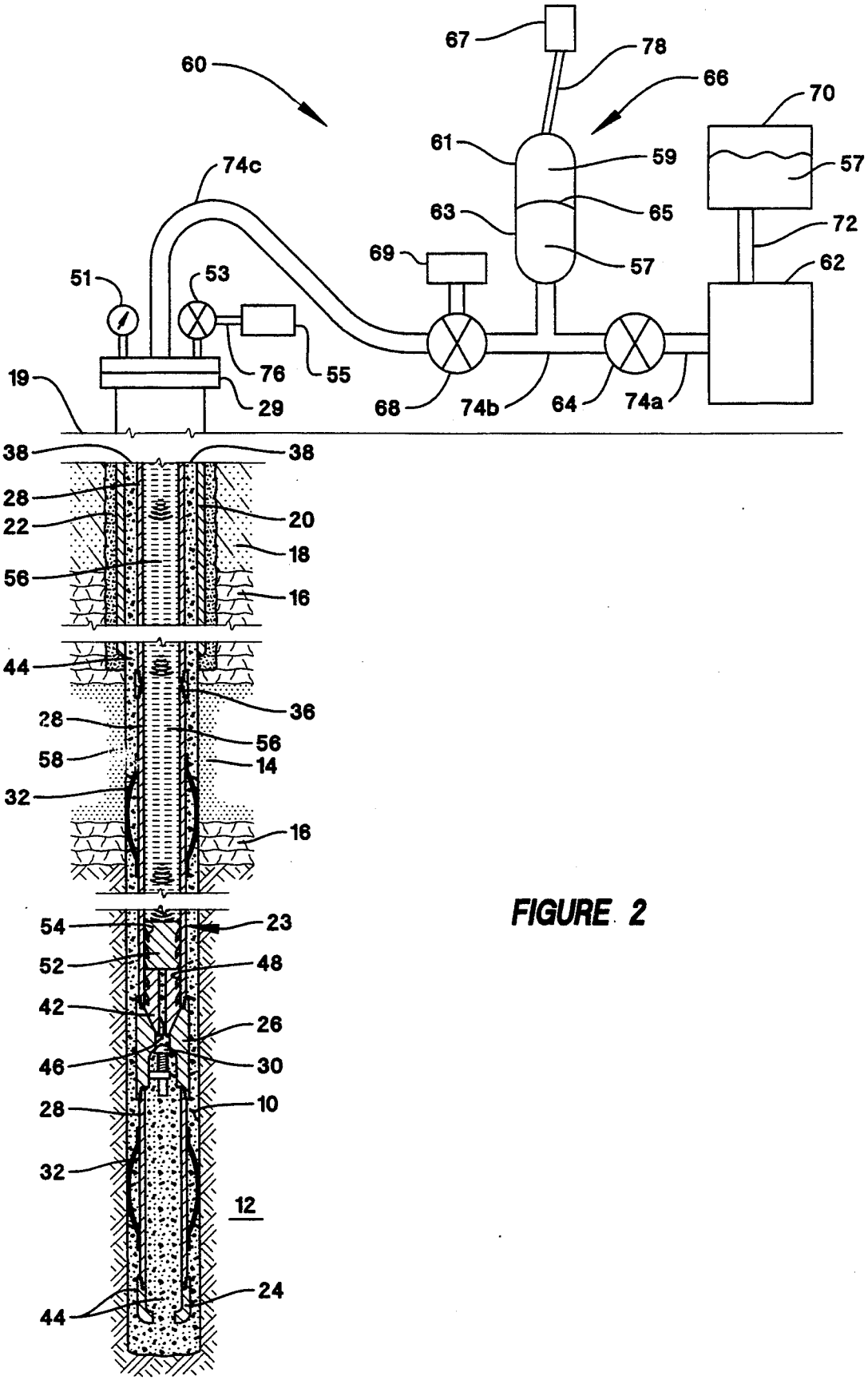
FIG. 2 illustrates a tube wave producing apparatus for injecting pressure pulses into a liquid-filled casing string.

FIG. 2 depicts a preferred embodiment of the apparatus for injecting pressure pulses into a liquid-filled wellbore. The tube wave producing apparatus, generally denoted as 60, comprises a rapid action valve 68 driven by a motor 69, an accumulator 66, a fluid flow regulation valve 64, a pressure source 62, a working fluid source 70, a fluid source conduit 72, and an accumulator conduit 74*a*, 74*b*, 74*c*. Accumulator conduit 74 is sealably connected to wellhead 29 of wellbore 10 extending below the ground surface 19. It is possible that in an alternative embodiment rapid action valve 68, accumulator 66, fluid flow regulation valve 64, and pressure source 62 are sufficiently close that accumulator conduit 74*c* may be unnecessary to use the apparatus. Accumulator conduit 74*a*, 74*b*, 74*c*, fluid source conduit 72, accumulator 66, fluid flow regulation valve 64, pressure source 62 and working fluid source 70 are well known and generally readily available to those skilled in the art.

The rapid action valve 68 may be in the form of a sturdy ball valve attached to a very powerful and fast acting mechanical actuator. Another form of the rapid action valve 68 would be that of an electrohydraulic servovalve, commonly used in industrial applications such as die casting, injection molding, or vibration exciters. In any event, the rapid action valve 68 must be capable of releasing in at least a one second time period a high pressure pulse of a fluid into a region under relatively lower pressure, such as displacement liquid 56. The repaid action valve 68 coupled with accumulator 66 call thereby produce in the displacement liquid 56 a high pressure pulse and a corresponding compression type tube wave, which travels downwardly through displacement liquid 56. When each high pressure pulse impacts a boundary condition formed by a casing restriction or barrier, such as top cementing plug 52, the suspended casing 28 is vibrated as it is extended downwardly in response to the high pressure pulse impact.

A pressure gauge 51 and pressure relief valve 53, each attached to wellhead 29, are in communication with the bore of casing string 23. Displacement liquid 56 can be maintained at a relatively constant pressure, preferably ambient, by releasing excess liquid through pressure relief valve 53 into a working fluid reservoir 55 via fluid reservoir conduit 76 when the pressure in casing string 23 exceeds a predetermined level. Maintaining a pressure differential between the pressure of the injected working fluid 57 and the displacement liquid 56 is required to produce a tube wave. Therefore, pressure relief should occur as frequently as needed to ensure that the pressure of displacement liquid 56 is restored substantially near its initial pressure before receiving the next pressure pulse. The relief valve 53 is preferably opened and closed shortly before rapid action valve 68 is opened for delivering another pressure pulse.

An alternative embodiment of the invention includes using a sealed pipe as a pressure source/accumulator. Casing string 23 with top cementing plug 52 positioned as shown in FIG. 2 could operate as such a pressure source/accumulator. Under this embodiment of the invention, the casing string 23 is overpressured by pumping additional displacement liquid 56 into it, and accumulator 66 would be maintained at a lower pressure, preferably ambient. The pressure in casing string 23 may be quickly vented by releasing the high pressure displacement liquid 56 through rapid action valve 68 to accumulator 66. This abrupt venting process produces a low pressure pulse and a corresponding rarefaction type tube wave, which travels downwardly through displacement liquid 56. When the low pressure pulse impacts a boundary condition formed by a casing restriction or barrier, such as top cementing plug 52, the suspended casing 28 is vibrated as it rises in response to the low pressure pulse impact. It will be understood by those skilled in the art that in this embodiment of the invention, fluid flow regulation valve 64 would be maintained closed since pressure source 62 and working fluid source 70 are not needed. Also, a means for pressurizing displacement liquid 56 (not shown) would be required.

Referring again to FIG. 2, in operation the accumulator 66 of apparatus 60 is preferably used to inject working fluid 57 into a liquid filled casing string 23 via accumulator conduit 74 and rapid action valve 68. As described above, displacement liquid 56 typically resides in the casing string 23 following placement of the cement slurry 44 in the annulus 38. Displacement liquid 56 is preferably water because of its relatively low viscosity which helps provide for relatively small liquid-solid frictional force affects. Pressure pulses are produced as the working fluid 57 is injected into the displacement liquid 56 through rapid action valve 68.

The working fluid 57 does not necessarily need to be identical or similar in composition to the displacement liquid 56. Preferably the working fluid 57 is also water which would help minimize any wear on the components of tube wave producing apparatus 60. The working fluid could also be comprised of a drilling mud, an oil, or, as discussed below, a gas. Where the displacement liquid 56 contains fines or particles which would reduce the useful life of the equipment comprising the tube wave producing apparatus 60, a membrane (not shown) may be used to separate the working fluid 57 and displacement liquid 56. Alternatively, working fluid 57 and displacement liquid 56 may be allowed to mix at an interface downstream from the rapid action valve 68.

The fluid flow regulation valve 64 does not require a fast acting opening and closing capability like rapid action valve 68, and therefore, may consist of a simple ball valve, gate valve, or similar device. Pressure source 62 pumps working fluid 57 from working fluid source 70 into accumulator conduit 74 via fluid source conduit 72 as fluid flow regulation valve 64 and rapid action valve 68 are opened. Working fluid 57 is pumped into accumulator conduit 74 until it becomes completely filled with working fluid 57, at which point rapid action valve 68 is closed. After rapid action valve 68 is closed, pressure source 62 continues to pump working fluid 57 which is stored under pressure in accumulator 66 as described below. After working fluid 57 is stored at a predetermined pressure in accumulator 66, fluid flow regulation valve 64 is preferably closed, but may be left open if desired.

Accumulator 66 is separated into a gas containing compartment 61 and a fluid containing compartment 63 by diaphragm 65. Additional gas 59 may be introduced into accumulator 66 via conduit 78 from an external gas source 67 such as a pump or pressurized gas cylinder to increase the pressure on working fluid 57 as the introduced gas presses against diaphragm 65. Diaphragm 65 is constructed from a flexible, elastomeric material that stretches under pressure but returns to its original shape when pressure is released. The working fluid 57 in compartment 63 is relatively incompressible as compared to the gas 59 in gas compartment 61. As pressure source 62 continues to pump working fluid 57 to accumulator 66, the increasing volume of working fluid 57 in fluid compartment 63 exerts pressure against diaphragm 65, thereby causing diaphragm 65 to stretch and pressurize the volume of gas 59 in gas compartment 61. Consequently, the working fluid 57 is stored under pressure in accumulator 66.

Generally, the frequency of the tube wave in hertz (i.e., cycles per second), produced by a corresponding pressure pulse will be approximately equal to the reciprocal of the time period, in seconds, rapid action valve 68 remains open. Once the working fluid 57 in accumulator 66 is under sufficient pressure, rapid action valve 68 is opened for a time period dictated by the desired tube wave frequency. The preferred tube wave frequency is about one hertz. Therefore, rapid action valve 68 should open and close in about one second to produce a one hertz tube wave. Some or all of the energy stored as pressure in accumulator 66 is released when rapid action valve 68 is opened. As the pressure differential across rapid action valve 68 seeks equilibrium, a portion of the working fluid 57 in fluid compartment 63 is injected into displacement liquid 56 as a pressure pulse.

The process of closing rapid action valve 68, storing working fluid 57 under pressure in accumulator 66, and then opening rapid action valve 68 again can be repeated to create a pulsing pattern. Rapid action valve 68 may be driven by a motor 69 controlled by a microprocessor (not shown). Such an automated design would permit the rapid action valve 68 to produce a preprogrammed pulsing pattern and/or to operate in response to electronic input from a device monitoring the casing vibrations, such as an accelerometer.

An alternative device for producing a compression type tube wave could be an airgun (not shown) or similar device which would inject a high pressure gas pulse as the working fluid 57. Such a device is typically used for producing seismic data in geophysical prospecting. However, airguns normally used in geophysical prospecting produce tube waves around 60–80 hertz. Therefore, some minor modifications, well known to those skilled in the art, would be required for such a device to produce a tube wave of about one hertz.

Pressure pulses are injected into the displacement liquid 56 until the cement slurry develops sufficient strength to prevent annular fluid flow caused by pressurized formation fluids as they enter the cement-filled annulus 38. Typically, the time period for injecting such pressure pulses will fall within the range of about 3 hours to about 24 hours depending on local borehole conditions. Preferably, a periodic or intermittent pulsing pattern with a fixed or variable time delay between pressure pulses is used. However, pressure pulses may also be injected substantially continuously as the cement slurry cures.

Figure 3:
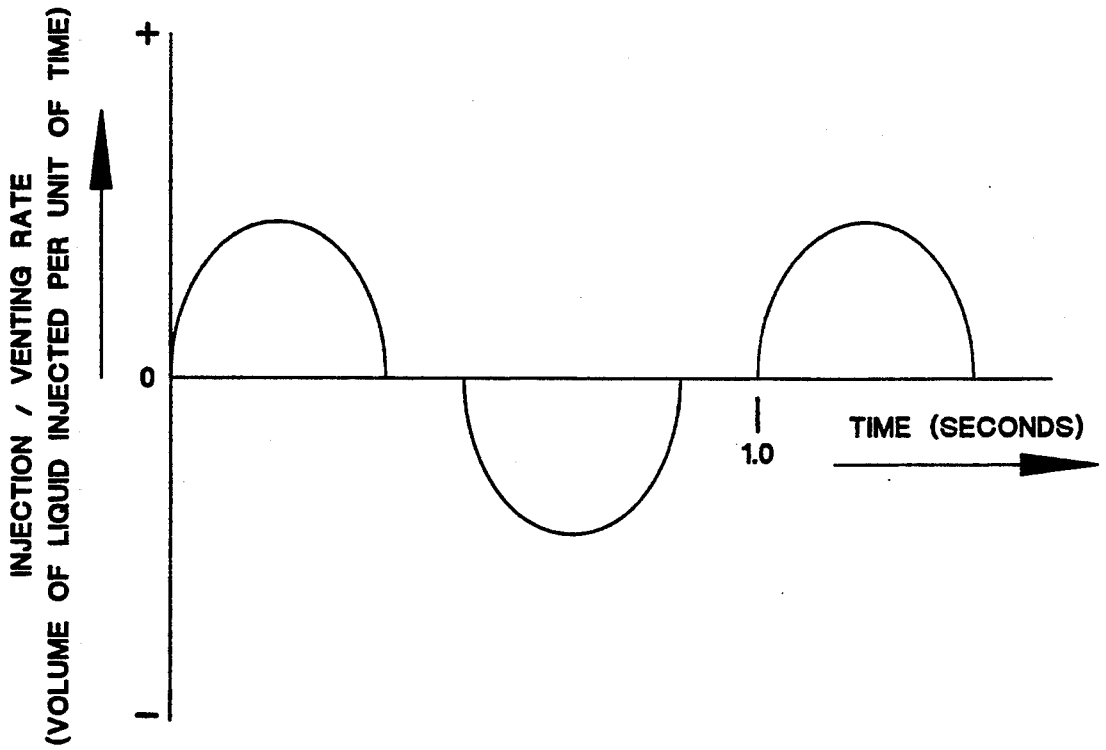
FIG. 3 is a plot of the rate of flow of a liquid injected into and vented from a well casing over time to produce a substantially continuous vibration in the well casing.

A continuous pressure pulsing pattern can be produced by the sequential injection of working fluid 57 and venting of a portion of the displacement liquid 56/working fluid 57 mixture thereby produced. Such a pulsing pattern would produce a series of tube waves comprising alternating compression and rarefaction type tube waves. A continuous pulsing pattern may be produced by installing a second rapid action valve and corresponding accumulator (not shown) in place of relief valve 53 and working fluid reservoir 55. The second accumulator would be maintained at a pressure below the pressure of the displacement liquid 56/working fluid 57 mixture at the wellhead 29. This continuous pulsing pattern can be established by continuously repeating the steps of (1) opening the first rapid action valve 68 to inject a preselected volume of working fluid 57, (2) closing rapid action valve 68, (3) opening the second rapid action valve (not shown) to vent a substantially equal volume of a displacement liquid 56/working fluid 57 mixture into the second accumulator (not shown), and (4) closing the second rapid action valve (not shown). A periodic wave form will be created by alternately injecting into and venting from casing string 23 substantially equal volumes of liquids at substantially equal rates. As indicated in FIG. 3 a period of about one second for injecting and venting liquids from casing string 23 will produce tube waves of about one hertz.

As discussed above, tube waves created by the pressure pulses travel the length of the casing string 23 through the displacement liquid 56 until they encounter the boundary created by top cementing plug 52, and thereby vibrate the casing string 23 sufficiently to break the gel strength in cement slurry 44. The inventor's studies have shown that casing vibration having a longitudinal displacement of at least 0.25 inches along the wellbore axis is normally more than sufficient to break the gel strength of cement slurry 44 around the region of vibration.

Where a tube wave producing apparatus 60 is used, the pressure of the working fluid 57 stored in accumulator 66 is preferably in the range of approximately 500–1000 p.s.i. Preferably the rapid action valve 68 is opened and closed in about one second to produce a tube wave having a frequency of about one hertz. Each pressure pulse corresponding to the tube wave is preferably injected intermittently at about one to five minute intervals over a period of approximately 12 hours. Under the above pressure and tube wave frequency conditions, the casing string 23 will undergo a longitudinal displacement of typically about 1 to 1.5 inches. The exact displacement depends on the length of the casing string, tube wave damping, frequency used and other factors.

The magnitude of this longitudinal displacement can be enhanced by a resonance effect produced by tube waves having a frequency equal to the frequency of a standing wave established in the casing string's vibration. The frequency of a standing wave or the resonance frequency ($f_R$) is defined by the following relationship:

$$f_R = \frac{v_T}{\lambda_{T/R}}$$

where $v_T$=the velocity of the tube wave, and $\lambda_{T/R}$=the wavelength of the tube wave necessary to induce a resonance condition.

$\lambda_{T/R}$ may be equal to the product of any odd quarter multiple (i.e., $\frac{1}{4}$, $\frac{3}{4}$, 5/4, etc.) and 1/L, where L is the length of the casing string 23. Therefore, $f_R$ may be any odd quarter multiple of $v_T/L$ to produce a resonance condition. The strongest resonance conditions will be produced with $f_R$ less than about one hertz. Therefore, using a $\frac{3}{4}$ multiple yields a preferred $f_R$ equal to $\frac{3}{4}$ ($v_T/L$) for a casing string 5000 ft. in length. For example, a tube wave with $v_T$=4,500 ft./sec. in a casing string with L=5,000 ft. should have a frequency of about 0.7 cycle/sec. or about 0.7 hertz to produce a resonance condition.

As indicated above, $v_T$ is typically about 4,500 ft./sec. This is a relatively constant value under most any circumstances. Therefore, since L is a known value, the time period for rapid action valve 68 to remain open for producing a tube wave with a resonance frequency may be precalculated. As discussed previously the tithe period rapid action valve 68 remains open dictates the frequency of the tube wave thereby produced. Also, the resonance frequency may be determined by using an accelerometer (not shown) attached to casing string 23. As the time period the rapid action valve 68 remains open is varied a resonance frequency can be identified when the output of the accelerometer obtains a peak value. The rapid action valve time period which produces such a peak value can then be set to produce tube waves with a resonance frequency.

The vibration of casing string 23 will induce extensional waves in the wall of the casing string 23 which will travel upwardly toward the surface 19. As discussed above, extensional waves can contribute significantly to the vibration of the casing string but are diminished by damping frictional forces. Using the inventive method, however, the extensional waves are initiated, and therefore are strongest, in the region of the hydrocarbon zone where preventing annular fluid flow is most critical. Also, the magnitude of the longitudinal displacement produced by the tube wave ensures that resulting extensional waves will travel substantial distances up the casing string 23.

The method of the present invention and the best mode contemplated for practicing the invention have been described. It should be understood that the invention is not to be unduly limited to the foregoing which has been set forth for illustrative purposes. Various modifications and alterations of the inventive method will be apparent to those skilled in the art without departing from the true scope of the invention defined in the following claims.

What I claim is:

1. A method for cementing a well casing in a well which passes through at least one subterranean formation containing pressurized formation fluids, said well casing being inserted in said well so as to define an annulus between said well casing and the wall of said well, said method comprising the steps of:

a) introducing a cement slurry having a pressure at least equal to the pressure of said pressurized formation fluids into said annulus;

b) introducing a displacement liquid into said well casing;

c) maintaining said pressure of said cement slurry at least equal to the pressure of said pressurized formation fluids until said cement slurry has developed sufficient strength to prevent said pressurized formation fluids from entering said annulus, said pressure of said cement slurry being maintained by causing vibration in said well casing;

d) said vibration being caused by at least one tube wave propagating through at least a portion of said displacement liquid and encountering at least one boundary condition in said well casing.

2. The method of claim 1 wherein said tube wave is generated by injecting a high pressure pulse into said displacement liquid, said pressure pulse having a higher pressure than the pressure of said displacement liquid.

3. The method of claim 2 wherein said high pressure pulse has a pressure between about 500 to about 1,000 p.s.i. greater than said displacement liquid pressure.

4. The method of claim 1 wherein said tube wave is generated by venting a portion of said displacement liquid to create a low pressure pulse having a lower pressure than the pressure of said displacement liquid.

5. The method of claim 4 wherein said low pressure pulse has a pressure between about 500 to about 1,000 p.s.i. less than said displacement liquid pressure.

6. The method of claim 1 wherein a plurality of tube waves are generated by alternately injecting a high pressure pulse into said displacement liquid and venting a portion of said displacement liquid to create a low pressure pulse, said high pressure pulse having a higher pressure than the pressure of said displacement liquid and said low pressure pulse having a lower pressure than the pressure of said displacement liquid, whereby said tube waves cause said vibration to be substantially continuous.

7. The method of claim 1 wherein said vibration is intermittent.

8. The method of claim 1 wherein said tube wave has a frequency of about one hertz.

9. The method of claim 1 wherein said vibration of said well casing is in a resonance condition resulting from said tube wave having a frequency substantially equal to a resonance frequency for said well casing.

10. The method of claim 2 wherein said high pressure pulse is produced by injecting a second liquid into said displacement liquid.

11. The method of claim 2 wherein said high pressure pulse is produced by injecting a gas into said displacement liquid.

12. A method for vibrating a well casing being cemented into a well which passes through at least one subterranean formation containing pressurized formation fluids so as to maintain the pressure of the cement slurry in the annulus around said well casing at or above the pressure of said formation fluids until said cement slurry has developed sufficient strength to prevent said formation fluids from entering said annulus, said well casing containing a displacement fluid and having a boundary condition located therein, said method comprising the steps of:

a) generating at least one tube wave in said displacement liquid; and b) permitting said tube wave to propagate through at least a portion of said displacement liquid until said tube wave encounters said boundary condition.

13. The method of claim 12 wherein said tube wave is generated by injecting a high pressure pulse, into said displacement liquid, said pressure pulse having a higher pressure than the pressure of said displacement liquid.

14. The method of claim 13 wherein said high pressure pulse has a pressure between about 500 to about 1,000 p.s.i. greater than said displacement liquid pressure.

15. The method of claim 12 wherein said tube wave is generated by venting a portion of said displacement liquid to create a low pressure pulse having a lower pressure than the pressure of said displacement liquid.

16. The method of claim 15 wherein said low pressure pulse has a pressure between about 500 to about 1,000 p.s.i. less than said displacement liquid pressure.

17. The method of claim 12 wherein a plurality of tube waves are generated by alternately injecting a high pressure pulse into said displacement liquid and venting a portion of said displacement liquid to create a low pressure pulse said high pressure pulse having a higher pressure than the pressure of said displacement liquid and said low pressure pulse having a lower pressure than the pressure of said displacement liquid, whereby said tube waves cause said vibration to be substantially continuous.

18. The method of claim 12 wherein said vibration is intermittent.

19. The method of claim 12 wherein said tube wave has a frequency of about one hertz.

20. The method of claim 12 wherein said vibration of said well casing is in a resonance condition resulting from said tube wave having a frequency substantially equal to a resonance frequency for said well casing.

21. The method of claim 13 wherein said high pressure pulse is produced by injecting a second liquid into said displacement liquid.

22. The method of claim 13 wherein said high pressure pulse is produced by injecting a gas into said displacement liquid.

* * * * *